US009020174B2

(12) United States Patent
Åsnes et al.

(10) Patent No.: US 9,020,174 B2
(45) Date of Patent: Apr. 28, 2015

(54) BONE CONDUCTION DEVICE HAVING AN INTEGRATED HOUSING AND VIBRATOR MASS

(75) Inventors: Kristian Åsnes, Molndal (SE); Patrick Wilhelm Strömsten, Molnlycke (SE)

(73) Assignee: Cochlear Limited, Macquarie University, NSW (AU)

( * ) Notice: Subject to any disclaimer, the term of this patent is extended or adjusted under 35 U.S.C. 154(b) by 436 days.

(21) Appl. No.: 13/260,511

(22) PCT Filed: Mar. 25, 2010

(86) PCT No.: PCT/US2010/028706

§ 371 (c)(1),
(2), (4) Date: Dec. 27, 2011

(87) PCT Pub. No.: WO2010/111519

PCT Pub. Date: Sep. 30, 2010

(65) Prior Publication Data

US 2012/0088956 A1 Apr. 12, 2012

(30) Foreign Application Priority Data

Mar. 25, 2009 (DE) ..... 10 2009 014 774

(51) Int. Cl.

| | |
|---|---|
| ***H04R 25/00*** | (2006.01) |
| *H04R 9/06* | (2006.01) |
| *H04R 15/00* | (2006.01) |
| *H04R 17/00* | (2006.01) |

(52) U.S. Cl.
CPC ..... *H04R 25/606* (2013.01); *H04R 9/066* (2013.01); *H04R 15/00* (2013.01); *H04R 17/00* (2013.01); *H04R 2460/13* (2013.01)

(58) Field of Classification Search
USPC ..... 381/380, 326, 312–321; 600/25; 181/129, 126, 134–135; 607/136
See application file for complete search history.

(56) References Cited

U.S. PATENT DOCUMENTS 2,045,404 A * 6/1936 Nicholides ..... 381/151
5,800,336 A * 9/1998 Ball et al. ..... 600/25

FOREIGN PATENT DOCUMENTS

WO 2007/140367 12/2007

OTHER PUBLICATIONS

Extended European Search Report for European Application No. 10756862.8 mailed Jan. 21, 2013 (6 pages).

(Continued)

*Primary Examiner* — Curtis Kuntz
*Assistant Examiner* — Sunita Joshi

(57) ABSTRACT

A bone conduction hearing aid device comprising a vibrator configured to vibrate in response to sound signals received by the device. The device further comprises a housing mass forming a housing for one or more operational components of the device, wherein the housing mass is attached to the vibrator so as to move in response to the vibration. The device also comprises a coupling configured to attach the device to a recipient so as to deliver the generated mechanical to the recipient's skull.

25 Claims, 6 Drawing Sheets

(56) References Cited

U.S. PATENT DOCUMENTS

| | | | | |
|---|---|---|---|---|
| 7,442,164 | B2 * | 10/2008 | Berrang et al. | 600/25 |
| 2006/0045298 | A1 * | 3/2006 | Westerkull | 381/326 |
| 2007/0041595 | A1 | 2/2007 | Carazo et al. | |
| 2007/0053536 | A1 | 3/2007 | Westerkull | |
| 2007/0156011 | A1 * | 7/2007 | Westerkull | 600/25 |
| 2008/0292125 | A1 * | 11/2008 | Asnes | 381/326 |
| 2009/0023109 | A1 * | 1/2009 | Jinton et al. | 433/174 |

OTHER PUBLICATIONS

International Application No. PCT/US2010/028706, International Search Report mailed on May 20, 2010, 2 Pages.

International Application No. PCT/US2010/028706, Written Opinion mailed on May 20, 2010, 4 Pages.

Official Action in counterpart European Application No. 10756862.8, mailed Mar. 17, 2014, 5 pages.

* cited by examiner

BONE CONDUCTION DEVICE HAVING AN INTEGRATED HOUSING AND VIBRATOR MASS

CROSS-REFERENCE TO RELATED APPLICATIONS

This application is a national stage application of PCT Application No. PCT/US2010/028706, entitled, "A Bone Conduction Device Having An Integrated Housing And Vibrator Mass," filed on Mar. 25, 2010, which claims priority from German Patent Application No. 102009014774.8, filed Mar. 25, 2009, which is hereby incorporated by reference herein.

BACKGROUND

1. Field of the Invention

The present invention relates generally to bone conduction devices, and more particularly, to a bone conduction device having an integrated housing and vibrator mass.

2. Related Art

Hearing loss, which may be due to many different causes, is generally of two types, conductive and sensorineural. Sensorineural hearing loss is due to the absence or destruction of the hair cells in the cochlea that transduce sound signals into nerve impulses. Various prosthetic hearing implants have been developed to provide individuals who suffer from sensorineural hearing loss with the ability to perceive sound. One such prosthetic hearing implant is referred to as a cochlear implant. Cochlear implants use an electrode array implanted in the cochlea of a recipient to bypass the mechanisms of the ear. More specifically, an electrical stimulus is provided via the electrode array directly to the auditory nerve, thereby causing a hearing sensation.

Conductive hearing loss occurs when the normal mechanical pathways that provide sound to hair cells in the cochlea are impeded, for example, by damage to the ossicular chain or ear canal. However, individuals suffering from conductive hearing loss may retain some form of residual hearing because the hair cells in the cochlea may remain undamaged.

Still other individuals suffer from mixed hearing losses, that is, conductive hearing loss in conjunction with sensorineural hearing. Such individuals may have damage to the outer or middle ear, as well as to the inner ear (cochlea).

Individuals suffering from conductive hearing loss are typically not candidates for a cochlear implant due to the irreversible nature of the cochlear implant. Specifically, insertion of the electrode assembly into a recipient's cochlea exposes the recipient to potential destruction of the majority of hair cells within the cochlea. Typically, destruction of the cochlea hair cells results in the loss of residual hearing in the portion of the cochlea in which the electrode assembly is implanted.

Rather, individuals suffering from conductive hearing loss typically receive an acoustic hearing aid, referred to as a hearing aid herein. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

Unfortunately, not all individuals who suffer from conductive hearing loss are able to derive suitable benefit from hearing aids. For example, some individuals are prone to chronic inflammation or infection of the ear canal thereby eliminating hearing aids as a potential solution. Other individuals have malformed or absent outer ear and/or ear canals resulting from a birth defect, or as a result of medical conditions such as Treacher Collins syndrome or Microtia. Furthermore, hearing aids are typically unsuitable for individuals who suffer from single-sided deafness (total hearing loss only in one ear). Hearing aids commonly referred to as "cross aids" have been developed for single sided deaf individuals. These devices receive the sound from the deaf side with one hearing aid and present this signal (either via a direct electrical connection or wirelessly) to a hearing aid which is worn on the opposite side. Unfortunately, this requires the recipient to wear two hearing aids. Additionally, in order to prevent acoustic feedback problems, hearing aids generally require that the ear canal be plugged, resulting in unnecessary pressure, discomfort, or other problems such as eczema.

As noted above, hearing aids rely primarily on the principles of air conduction. However, other types of devices commonly referred to as bone conducting hearing aids or bone conduction devices, function by converting a received sound into a mechanical force. This force is transferred through the bones of the skull to the cochlea and causes motion of the cochlea fluid. Hair cells inside the cochlea are responsive to this motion of the cochlea fluid and generate nerve impulses which result in the perception of the received sound. Bone conduction devices have been found suitable to treat a variety of types of hearing loss and may be suitable for individuals who cannot derive sufficient benefit from acoustic hearing aids, cochlear implants, etc, or for individuals who suffer from stuttering problems.

SUMMARY

In one aspect of the present invention, a bone conduction hearing aid device is provided. The bone conduction device comprises a vibrator configured to vibrate in response to sound signals received by the device; a housing mass forming a housing for one or more operational components of the device, wherein the housing mass is attached to the vibrator so as to move in response to the vibration; and a coupling configured to attach the device to a recipient so as to deliver mechanical forces generated by the movement of the housing mass to the recipient's skull.

In another aspect of the present invention, a bone conduction hearing aid device is provided. The bone conduction device comprises a vibrator configured to vibrate in response to sound signals received by the device; a housing mass forming a cavity for one or more operational components of the device, wherein the housing mass is attached to the vibrator so as to move in response to the vibration; a coupling configured to attach the device to a recipient so as to deliver mechanical forces generated by the movement of the housing mass to the recipient's skull; and a power supply disposed in the cavity.

BRIEF DESCRIPTION OF THE DRAWINGS

Embodiments of the present invention are described below with reference to the attached drawings, in which.

DETAILED DESCRIPTION

Embodiments of the present invention are generally directed to a bone conduction device for converting a received sound signal into a mechanical force for delivery to a recipient's skull. The bone conduction device comprises a vibrator configured to vibrate in response to sound signals received by the device, and an integrated housing and vibrator mass attached to the vibrator. The integrated housing and vibrator mass, referred to herein as a housing mass, is configured to house one or more operational components of the device. In certain embodiments, the housing mass comprises a substantially rigid and contiguous structure attached to the vibrator. The housing mass moves in response to the vibration of the vibrator to generate a mechanical force. The device further comprises a coupling configured to attach the device to a recipient so as to deliver the mechanical force generated by the housing mass and vibrator to the recipient's skull.

Figure 1:
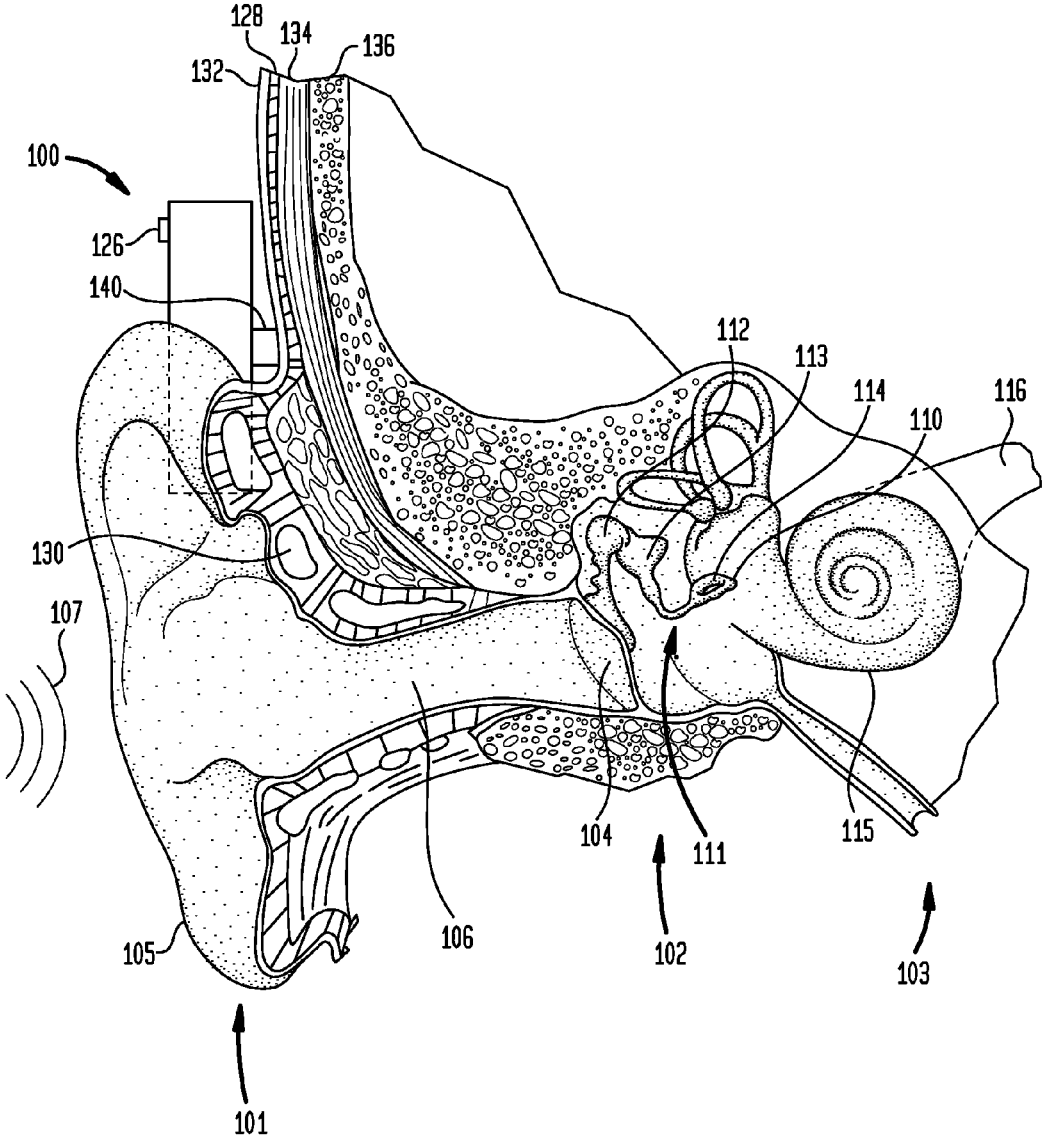
FIG. 1 is a perspective view of an exemplary bone conduction device worn behind a recipient's ear.

As noted above, bone conduction devices have been found suitable to treat various types of hearing loss and may be suitable for individuals who cannot derive suitable benefit from acoustic hearing aids, cochlear implants, etc. FIG. 1 is a perspective view of a bone conduction device 100 in which embodiments of the present invention may be advantageously implemented. As shown, the recipient has an outer ear 101, a middle ear 105 and an inner ear 107. Elements of outer ear 101, middle ear 105 and inner ear 107 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113 and the stapes 114. Bones 112, 113 and 114 of middle ear 102 serve to filter and amplify acoustic wave 107, causing oval window 110 to articulate, or vibrate. Such vibration sets up waves of fluid motion within cochlea 115. Such fluid motion, in turn, activates tiny hair cells (not shown) that line the inside of cochlea 115. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. As shown, bone conduction device 100 may be positioned behind outer ear 101 of the recipient and comprises a sound input element 126 to receive sound signals. Sound input element may comprise, for example, a microphone, telecoil, etc. As described below, sound input element may be located, for example, on the device, in the device, or on a cable extending from the device.

Also as described below, bone conduction device 100 may comprise a sound processor, a vibrator and/or various other operational components which facilitate operation of the device. More particularly, bone conduction device 100 operates by converting the sound signals received by microphone 126 into electrical signals. These electrical signals are processed by a sound processor within the device, and are provided to the vibrator. As described below, the vibrator converts the signals into mechanical motion used to output a force for delivery to the recipient's skull.

In accordance with embodiments of the present invention, bone conduction device 100 further includes a coupling 140 configured to attach the device to the recipient. In the specific embodiments of FIG. 1, coupling 140 is attached to an anchor system (not shown) implanted in the recipient. In the illustrative arrangement of FIG. 1, anchor system comprises a percutaneous abutment fixed to the recipient's skull bone 136. The abutment extends from bone 136 through muscle 134, fat 128 and skin 132 so that coupling 140 may be attached thereto. Such a percutaneous abutment provides an attachment location for coupling 140 that facilitates efficient transmission of mechanical force. A bone conduction device anchored to a recipient's skull is sometimes referred to as a bone anchored hearing aid (Baha). Baha is a registered trademark of Cochlear Bone Anchored Solutions AB (previously Entific Medical Systems AB) in Göteborg, Sweden.

It would be appreciated that embodiments of the present invention may be implemented with other types of couplings and anchor systems. Exemplary couplings and anchor systems that may be implemented in accordance with embodiments of the present invention include those described in the following commonly owned and co-pending U.S. Patent Applications: U.S. patent application Ser. No. 12/167,796, entitled "SNAP-LOCK COUPLING SYSTEM FOR A PROSTHETIC DEVICE," U.S. patent application Ser. No. 12/167,851, entitled "TANGENTIAL FORCE RESISTANT COUPLING SYSTEM FOR A PROSTHETIC DEVICE," U.S. patent application Ser. No. 12/167,871, entitled "MECHANICAL FIXATION SYSTEM FOR A PROSTHETIC DEVICE," U.S. patent application Ser. No. 12/167,825, entitled, "TISSUE INJECTION FIXATION SYSTEM FOR A PROSTHETIC DEVICE," U.S. patent application Ser. No. 12/168,636, entitled "TRANSCUTANEOUS MAGNETIC BONE CONDUCTION DEVICE," U.S. patent application Ser. No. 12/168,603, entitled "HEARING DEVICE HAVING ONE OR MORE IN-THE-CANAL VIBRATING EXTENSIONS," and U.S. patent application Ser. No. 12/168,620, entitled "PIERCING CONDUCTED BONE CONDUCTION DEVICE." The contents of these applications are hereby incorporated by reference herein. Additional couplings and/or anchor systems which may be implemented are described in U.S. Pat. No. 3,594,514, U.S. Patent Publication No. 2005/0020873, U.S. Patent Publication No. 2007/0191673, U.S. Patent Publication No. 2007/0156011, U.S. Patent Publication No. 2004/0032962, U.S. Patent Publication No. 2006/0116743 and International Application No. PCT/SE2008/000336. The contents of these applications are hereby incorporated by reference herein.

Figure 2:
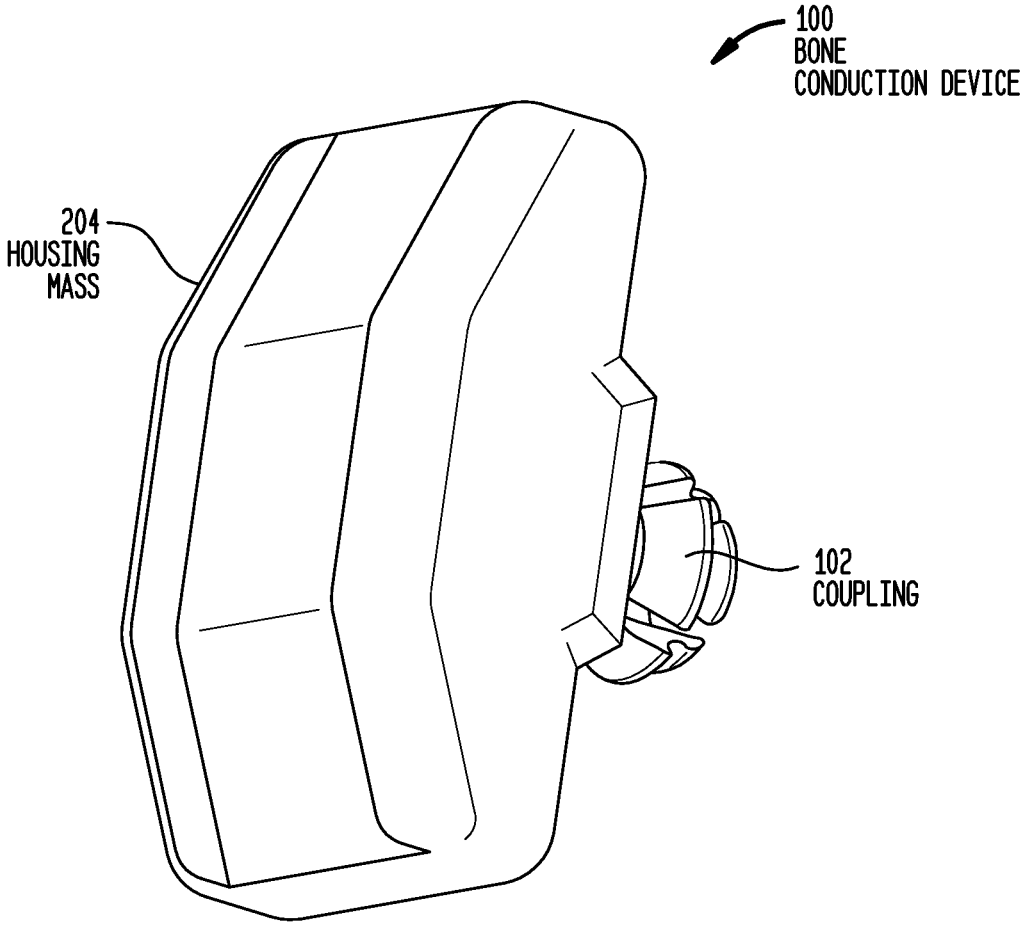
FIG. 2 is a perspective view of a bone conduction device in accordance with embodiments of the present invention.

FIG. 2 is a perspective view of an embodiment of bone conduction device 100 of FIG. 1. As noted above, a mass component is utilized in bone conduction device 100 to generate a mechanical force for delivery to the recipient's skull. As described in greater detail below, in accordance with embodiments of the present invention, the device comprises an integrated housing and vibrator mass. That is, the mass component forms the housing of the bone conduction device and is referred to as housing mass 204. Housing mass 204 is configured to have one or more components of the device positioned therein.

Figure 3:
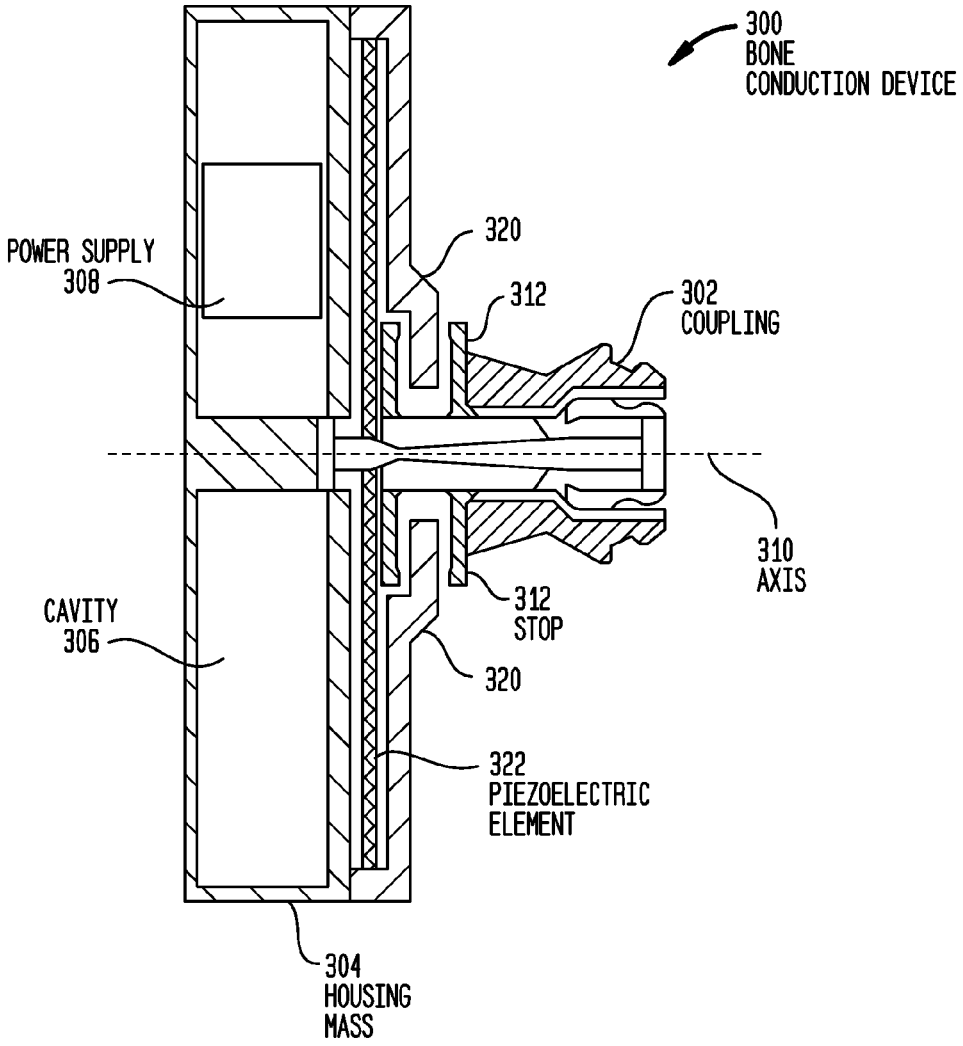
FIG. 3 is a cross-sectional schematic diagram of a bone conduction device in accordance with embodiments of the present invention.

FIG. 3 is a cross-sectional view of an embodiment of bone conduction device 100, shown as bone conduction device 300. As shown, bone conduction device 300 comprises a vibrator in the form of piezoelectric element 322. Piezoelectric element 322 comprises one or more active layers which mechanically deform (i.e. expand or contract) in response to application of the electrical signal thereto. This deformation (i.e. vibration) causes motion of a mass component attached to the piezoelectric element. Further details of the mass component implemented in accordance with embodiments of the present invention are provided below.

The motion of the piezoelectric element 322 and mass component generates a mechanical force that is transferred to the recipient's skull. The direction, amount of deformation of a piezoelectric layer in response to an applied electrical signal depends on material properties of the layer, orientation of the electric field with respect to the polarization direction of the layer, geometry of the layer, etc. As such, modifying the chemical composition of the piezoelectric layer or the manufacturing process may impact the deformation response of the layer. It would be appreciated that various materials have piezoelectric properties and may implemented in embodiments of the present invention. One commonly used piezoelectric material is lead zirconate titanate, commonly referred to as (PZT).

It would be appreciated that the type and configuration of a piezoelectric element that be implemented in the embodiments of FIG. 3 is not limited. In certain embodiments, piezoelectric element comprises a multilayered piezoelectric element. One exemplary multilayer piezoelectric element which may be implemented in embodiments of the present invention is a unimorph piezoelectric element comprising a single piezoelectric layer mounted to a passive layer. In other embodiments, piezoelectric element 322 may comprise a bimorph piezoelectric element comprising first and second piezoelectric layers separated by a flexible passive layer. In still other embodiments, piezoelectric element 322 may comprise a multilayer bimorph piezoelectric element. Furthers details of piezoelectric elements that may implemented in accordance with embodiments of the present invention are provided in commonly owned and co-pending U.S. patent application entitled "BONE CONDUCTION DEVICE HAVING A MULTILAYER PIEZOELECTRIC ELEMENT," filed Mar. 25, 2010, and which claims the benefit of German Application No. 102009014770.5, filed Mar. 25, 2009. The contents of these applications are hereby incorporated by reference herein The use of a multilayer piezoelectric element has the advantage that the voltage of an electric field utilized to actuate a multilayer element may be lower than the voltage utilized to actuate a single layer piezoelectric device. That is, a higher voltage electric field is required to generate a desired deflection of a single piezoelectric element than is required to generate the same desired deflection of a multilayer piezoelectric element. As such, a bone conduction device having a multilayer piezoelectric element have the advantage of requiring less power lower to produce desired mechanical force for delivery to a recipient's skull.

As noted above, a mass component is attached to piezoelectric element 322 for use in generating the mechanical force for delivery to the recipient's skull. For external mounting of a bone conducting device, generally additional energy is required as compared to internally mounted devices, and thus a larger mass is then needed. Devices having a larger dedicated mass component disposed within the device housing adds additional bulk and to the device. Rather than using a dedicated mass component, embodiments of the present invention have an integrated housing and mass, shown in FIG. 3A as housing mass 304. That is, in the embodiments of FIG. 3A, the mass component forms the housing of the bone conduction device.

As shown in FIG. 3A, housing mass 304 is attached to piezoelectric element 322. Housing mass 304 forms one or more cavities 306 in which one or more electronic components are positioned therein. For example, a power supply 308, such as a Lilon rechargeable battery, and/or other electronic circuitry as described above with reference to FIG. 1 are enclosed and protected inside housing mass 304.

In the configuration of FIG. 3A, the housing mass 304 is a metal such as brass, tungsten or a tungsten alloy. Additionally, because the housing mass 304 provides the device with the necessary mass and forms the device housing, a separate dedicated mass is not required. As such, bone conduction device 300 may have increased mass to improve the output of mechanical force without unduly increasing the bulk of the device. Additionally, due to the increased mass, the movements of piezoelectric element 322 may be smaller to generate a given force, as compared to devices having less mass. This reduction in movement of piezoelectric element 322 reduces feed-back problems.

As shown in FIG. 3, piezoelectric element 322 is attached to a coupling 302. Coupling 302 transfers the mechanical force generated by piezoelectric element 322 and housing mass 304 to the recipient's skull. In certain embodiments, coupling 302 may comprise a bayonet coupling, a snap-in or on coupling, a magnetic coupling, etc.

Bone conduction device 300 further comprises an overload protection element 320 attached to housing mass 304. Over-load protection element 320 is disposed between piezoelectric element 322 and coupling 302. As a result of deflection of piezoelectric element 322, overload protection element 320 is configured to contact stops 312 positioned on coupling 302. The contact between stops 312 and overload protection element 320 prevent undesired movement of piezoelectric element 322 and housing mass 304. Over-load protection element 320 also isolates piezoelectric element 322 from forces resulting from the use of coupling 302. For example, in embodiments which coupling 302 is a snap-in or on coupling, overload protection element 320 is configured to isolate piezoelectric element from snap-on and snap-off torques and forces.

In the embodiments of FIG. 3A, the maximum excitation of piezoelectric element 322 is on the same axis 310 as the combined center of housing mass 304 and coupling 302. This provides a well balanced device. Additionally, in certain embodiments of the present invention, the weight of bone conduction device 300 is approximately 25-35 grams. In specific such embodiments, housing mass 304 forms approximately 20-25 grams of this mass.

As shown in FIG. 3A, housing mass 304 has a flat, rectangular design, illustrated with a rectangular piezoelectric element 322. It would be appreciated that the configuration of FIG. 3 is merely illustrative and other shapes may also be implemented. For example, a housing mass may have, for example, oval, cylindrical, square or another customized shape. Additionally, piezoelectric element 322 may comprise piezoelectric strips, disks, plates, etc.

As noted above, bone conduction devices use a sound input element to receive sound signals. In embodiments of the present invention, the sound input element may comprise a microphone placed at the end of a cable extending from housing mass 304. In certain embodiments, the cable comprises a cable of approximately 20-40 mm. The cable may be flexible or rigid.

As noted, power supply 308 and other operational components may be positioned in housing mass 304. However, in an alternative embodiment, power supply 308 and electronic components may be placed externally in a separate unit.

Figure 4:
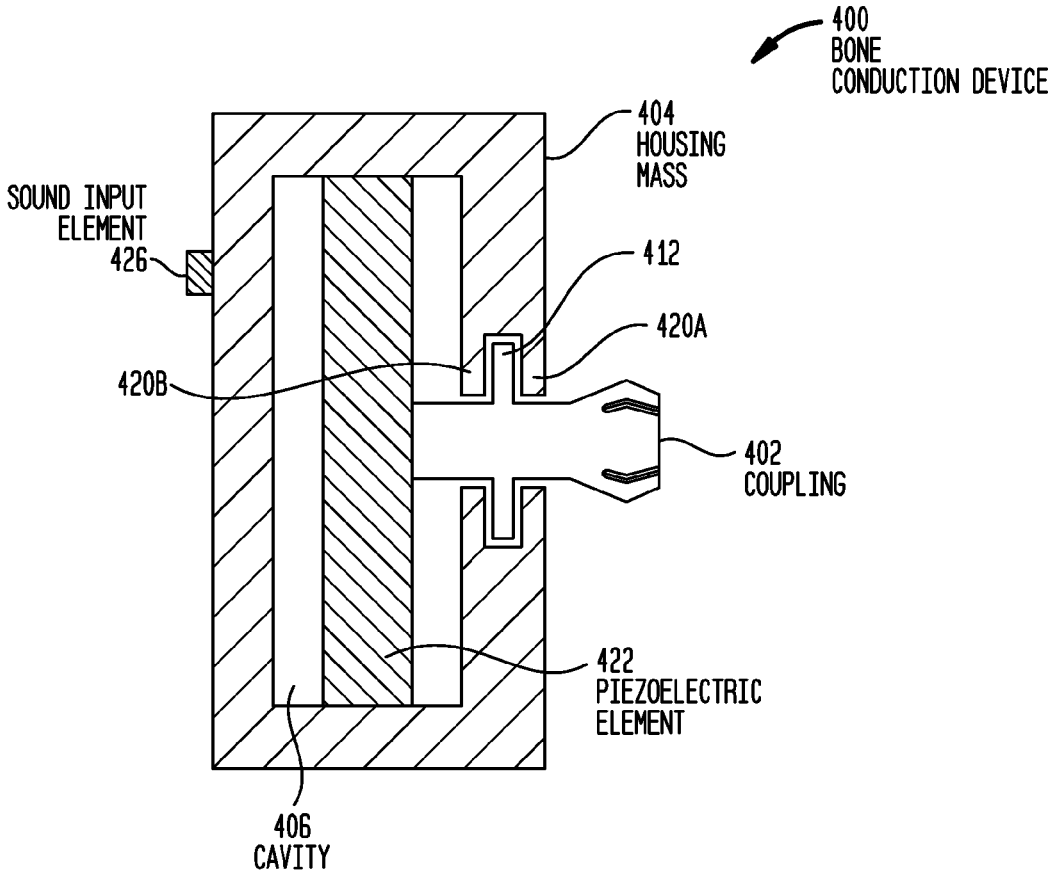
FIG. 4 is a cross-sectional schematic diagram of another bone conduction device in accordance with embodiments of the present invention.

FIG. 4 is a cross-sectional view of another bone conduction 400 in accordance with embodiments of the present invention. As shown, bone conduction device 400 comprises a housing mass 404 having a cavity 406 therein. Disposed in cavity 406 is a piezoelectric element 400 which is attached to housing mass 404. As noted above, piezoelectric element 400 deforms to cause motion of housing mass 404. This motion generates a mechanical force for delivery to the recipient's skull via coupling 402.

In the embodiments of FIG. 4, an over-load protection element is incorporated into housing mass 404. Specifically, over-load protection element is provided by projections 420. Stop members 412 extend from opposing sides of coupling 402 between projections 420. Contact between stop members 412 and overload protection elements 420 prevent undesired movement of piezoelectric element 422 and housing mass 404.

Bone conduction device 400 further comprises a sound input element 426 positioned thereon. As shown in FIG. 4, sound input element 426 is positioned on the surface of housing mass 404 opposing coupling 402. Sound input element 426 may oriented so that the element is parallel to the direction of vibration of piezoelectric element 422. The specific orientation of sound input element 426 may isolate the element from noise resulting from vibration of piezoelectric element 422 and movement of housing mass 404.

It would be appreciated that the sound input element arrangement of FIG. 4 is merely illustrative and that other arrangements may be implemented. For example, in an alternative embodiment, directional microphones may be used as the sound input element. Additionally, sound input element 426 may be positioned within cavity 406.

In other embodiments, sound input element 426 or may be positioned on a semi-rigid cable extending from housing mass 404. In such embodiments, the semi-rigid cable functions to isolate sound input element 426 from noise resulting from vibration of piezoelectric element 422 and movement of housing mass 404.

Figure 5:
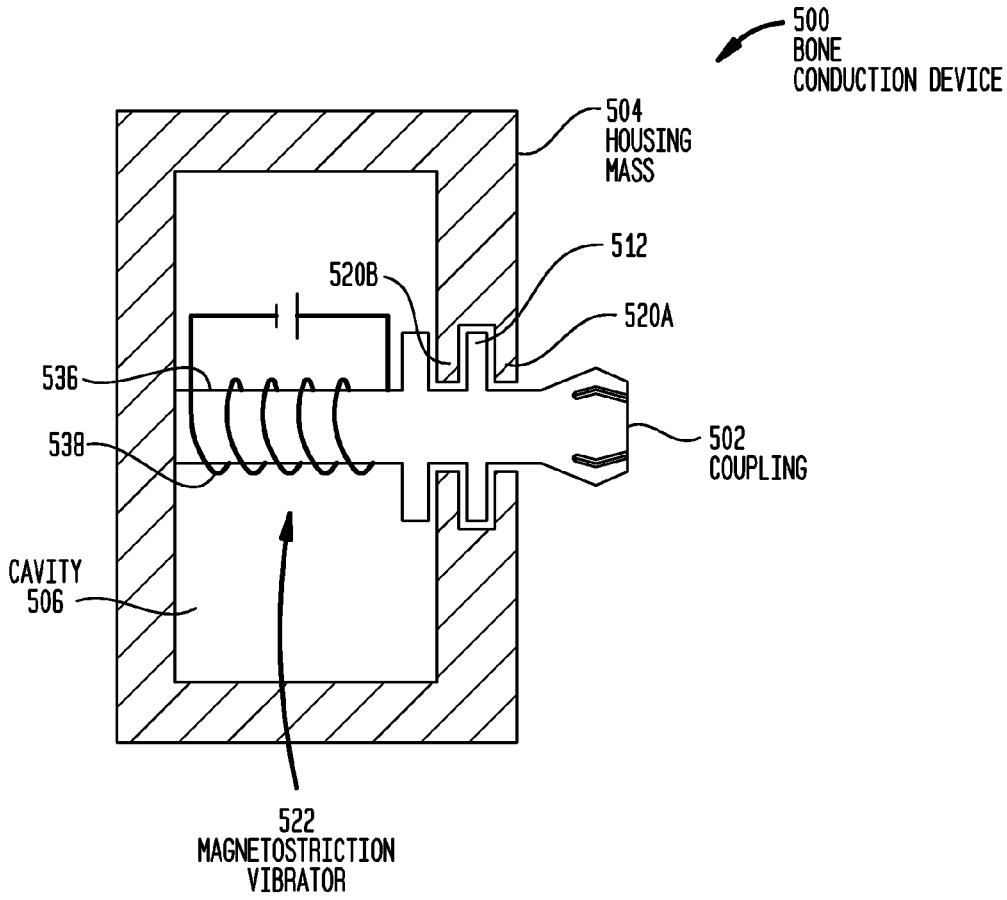
FIG. 5 is a cross-sectional schematic diagram of a bone conduction device in accordance with embodiments of the present invention.

FIG. 5 is a cross-sectional view of another bone conduction 500 in accordance with embodiments of the present invention. As shown, bone conduction device 500 comprises a housing mass 504 having a cavity 506 therein. Disposed in cavity 506 is a vibrator in the form of a magnetostriction vibrator 522, sometimes referred to as a magneto elastic vibrator. Magnetostriction vibrator 522 comprises a column 536 of magnetostrictive material which is configured to undergo mechanical deformations when subjected to an external magnetic field applied by coil 538. Magneto-elastic vibrators are known in the art and will not be described further herein. As shown, magneto-elastic vibrator is attached to housing mass 504 and generates vibrations which cause motion of housing mass 504. This motion generates a mechanical force for delivery to the recipient's skull via coupling 502.

In the embodiments of FIG. 5, an over-load protection element is incorporated into housing mass 504. Specifically, over-load protection element is provided by projections 520. Stop members 512 extend from opposing sides of coupling 402 between projections 520. Contact between stop members 512 and overload protection elements 420 prevent undesired movement of piezoelectric element 522 and housing mass 504.

Figure 6:
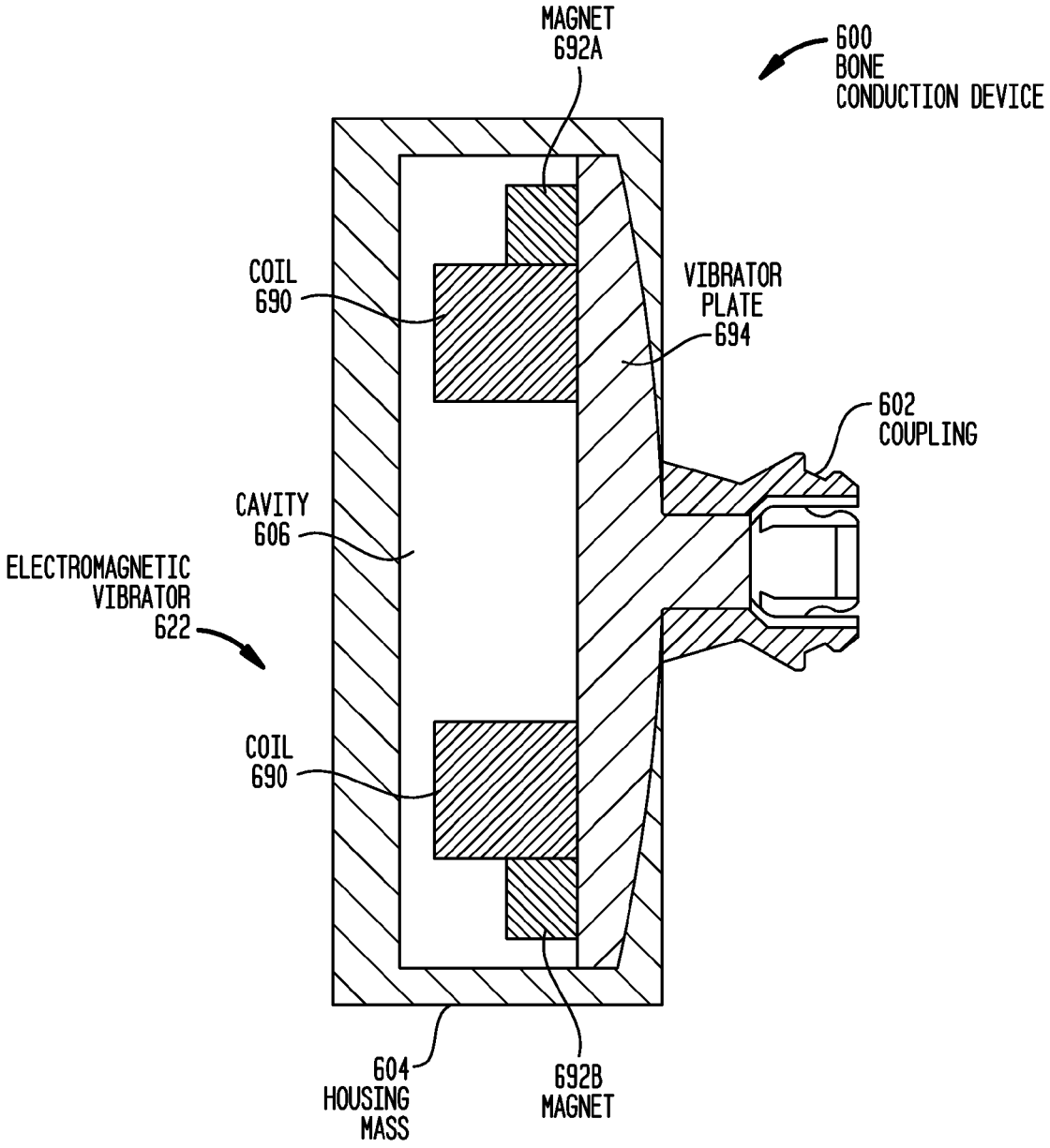
FIG. 6 is a cross-sectional schematic diagram of a bone conduction device in accordance with embodiments of the present invention.

Embodiments of the present invention have been primarily described with reference to bone conduction devices have piezoelectric or magneto-elastic vibrators. It would be appreciated that other types of vibrators may be implemented such as, for example, an electromagnetic vibrator. FIG. 6 is a schematic cross-sectional diagram of one such exemplary electro-magnetic bone conduction device 600 in accordance with embodiments of the present. As shown, bone conduction device 600 comprises a housing mass 604 having a cavity 606 therein. Disposed in cavity 606 is an electromagnetic vibrator 622. Electromagnetic vibrator 622 comprises a coil 690 and a plurality of magnets 692 to energize the coil. The energizing of coil 690 by magnets 692 causes vibration and resulting movement of housing mass 604. This motion generates a mechanical force for delivery to the recipient's skull via vibrator plate 694 and coupling 602.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents. All patents and publications discussed herein are incorporated in their entirety by reference thereto.

What is claimed is:

1. A bone conduction device comprising:

a vibrator configured to vibrate in response to sound signals received by the device;

a housing mass comprising a housing for one or more operational components of the device integrated with a vibrator mass, wherein the housing mass is attached to the vibrator so as to move along with the vibrator in response to the vibration to generate an output mechanical force representative of the sound signals;

a coupling configured to attach the device to a recipient so as to deliver the mechanical forces generated by the movement of the housing mass to the recipient's skull;

one or more stops positioned on the coupling; and one or more over-load protection elements disposed between the one or more stops and the vibrator and configured to contact the one or more stops to prevent undesired movement of the vibrator and housing mass in the direction of the coupling.

2. The bone conduction device of claim 1, wherein the housing mass comprises a contiguous substantially rigid structure.

3. The bone conduction device of claim 1, wherein the housing mass forms a cavity, and wherein the bone conduction device comprises:

a power supply disposed in the cavity.

4. The bone conduction device of claim 1, wherein the bone conduction device comprises:

one or more additional operational components disposed in the cavity.

5. The bone conduction device of claim 1, wherein the vibrator is disposed in, and is substantially surrounded by, the housing mass.

6. The bone conduction device of claim 1, wherein the vibrator comprises a piezoelectric element.

7. The bone conduction device of claim 6, wherein the piezoelectric element comprises a multilayer piezoelectric element.

8. The bone conduction device of claim 7, wherein the piezoelectric element comprises a bimorph piezoelectric element.

9. The bone conduction device of claim 1, wherein the vibrator comprises an electromagnetic vibrator.

10. The bone conduction device of claim 1, wherein the vibrator comprises a magnetostriction vibrator.

11. The bone conduction device of claim 1, wherein the one or more over-load protection elements comprise projections incorporated into the housing mass, and wherein at least one of the one or more stops are disposed between two of the projections.

12. The bone conduction device of claim 1, wherein the coupling comprises a snap-on coupling, and wherein the over-load protection element is configured to isolate the vibrator from torque resulting from use of the coupling.

13. The bone conduction device of claim 1, wherein the housing mass is at least one of tungsten and a tungsten alloy.

14. A bone conduction device comprising:

a vibrator configured to vibrate in accordance with received sound;

a housing mass comprising a vibrator mass integrated with a housing forming a cavity for one or more operational components of the device, wherein the housing mass is attached to the vibrator so as to move along with the vibrator to generate an output mechanical force representative of the sound signal;

a coupling configured to attach the device to a recipient so as to deliver the mechanical forces generated by the movement of the housing mass to the recipient's skull and comprising at least one stop;

a power supply disposed in the cavity; and one or more over-load protection elements disposed between the at least one stop and the vibrator and configured to contact the at least one stop to limit movement of the vibrator and housing mass.

15. The device of claim 14, wherein the housing mass comprises a contiguous substantially rigid structure.

16. The bone conduction device of claim 14, wherein the bone conduction device comprises:

one or more additional operational components disposed in the cavity.

17. The bone conduction device of claim 14, wherein the vibrator is disposed in, and is substantially surrounded by, the housing mass.

18. The bone conduction device of claim 14, wherein the vibrator comprises a piezoelectric element.

19. The bone conduction device of claim 18, wherein the piezoelectric element comprises a multilayer piezoelectric element.

20. The bone conduction device of claim 19, wherein the piezoelectric element comprises a bimorph piezoelectric element.

21. The bone conduction device of claim 14, wherein the vibrator comprises an electromagnetic vibrator.

22. The bone conduction device of claim 14, wherein the vibrator comprises a magnetostriction vibrator.

23. The bone conduction device of claim 14, wherein the one or more over-load protection elements comprise projections incorporated into the housing mass, and wherein the at least one stop is disposed between two of the projections.

24. The bone conduction device of claim 14, wherein the coupling comprises a snap-on coupling, and wherein the over-load protection element is configured to isolate the vibrator from torque resulting from use of the coupling.

25. The bone conduction device of claim 14, wherein the housing mass is at least one of tungsten and a tungsten alloy.

* * * * *